US008912876B2

(12) United States Patent
Gomi et al.

(10) Patent No.: US 8,912,876 B2
(45) Date of Patent: Dec. 16, 2014

(54) SURFACE MOUNTING VARISTOR

(75) Inventors: Yoji Gomi, Nagano (JP); Tatsuya Kanzaki, Sagamihara (JP)

(73) Assignee: KOA Corporation, Ina-Shi, Nagano (JP)

( * ) Notice: Subject to any disclaimer, the term of this patent is extended or adjusted under 35 U.S.C. 154(b) by 0 days.

(21) Appl. No.: 13/805,657

(22) PCT Filed: Jun. 17, 2011

(86) PCT No.: PCT/JP2011/063932

§ 371 (c)(1),
(2), (4) Date: Feb. 10, 2013

(87) PCT Pub. No.: WO2011/162181

PCT Pub. Date: Dec. 29, 2011

(65) Prior Publication Data

US 2013/0162388 A1 Jun. 27, 2013

(30) Foreign Application Priority Data

Jun. 21, 2010 (JP) ..... 2010-140671

(51) Int. Cl.
*H01C 7/10* (2006.01)
*H01C 7/102* (2006.01)

(52) U.S. Cl.
CPC . *H01C 7/10* (2013.01); *H01C 7/102* (2013.01)
USPC ..... 338/21

(58) Field of Classification Search
CPC ..... H01C 7/10; H01C 7/102
USPC ..... 338/21
See application file for complete search history.

(56) References Cited

U.S. PATENT DOCUMENTS

| | | | | |
|---|---|---|---|---|
| 4,933,811 | A * | 6/1990 | Dorlanne | 361/773 |
| 4,959,505 | A * | 9/1990 | Ott | 174/546 |
| 5,900,800 | A * | 5/1999 | McGuire et al. | 338/22 R |
| 5,990,779 | A * | 11/1999 | Katsuki et al. | 338/232 |
| 6,316,726 | B1 * | 11/2001 | Hidaka et al. | 174/538 |
| 8,421,583 | B2 * | 4/2013 | Koyama | 338/22 R |

FOREIGN PATENT DOCUMENTS

| | | | |
|---|---|---|---|
| JP | 56-89239 | U | 7/1981 |
| JP | 62-28423 | U | 2/1987 |
| JP | 62-234311 | A | 10/1987 |
| JP | 03-016255 | Y | 4/1991 |
| JP | 04-315402 | A | 11/1992 |
| JP | 06-163315 | A | 6/1994 |
| JP | 09-266101 | A | 10/1997 |
| JP | 63-46802 | U | 3/1998 |
| JP | 2002-231120 | A | 8/2002 |

OTHER PUBLICATIONS

International Search Report, directed to International Patent Application No. PCT/JP2011/063932, 2 pages.

* cited by examiner

*Primary Examiner* — Kyung Lee
(74) *Attorney, Agent, or Firm* — Smith Patent Office

(57) ABSTRACT

A surface mounting varistor for high voltages and current pulses without any risk of burning a mounting board is provided. A covering material for a varistor 1 has a duplex (two layer) structure made from a first mold layer 13 and a second mold layer 15, and a leg with a predetermined height is formed on the bottom of the covering material. As a result, a space (void) formed between a varistor element 2 and a mounting board 20 when the varistor 1 is mounted on the board 20 allows avoidance of the risk of burning the board 20, even if the varistor short-circuits.

7 Claims, 8 Drawing Sheets

SURFACE MOUNTING VARISTOR

TECHNICAL FIELD

The present invention relates to a surface mounting varistor for protecting electronic devices etc. from various surges or pulse noises, for example.

BACKGROUND ART

Service conditions for electronic components used in automobiles, industrial instruments etc. have changed remarkably, technical standards not yet required for those components conventionally have thus been amended accordingly, and applications thereof have been diversifying. As a result, electronic components for protecting electronic circuits vulnerable to unexpected noise or a large pulse are in high demand. Furthermore, it is in demand to take environmental influences of sulfuration, dew condensation etc. into account and to provide products with not only an initial function but also a continuously, highly reliable function.

Varistors functioning as a circuit protection device are divided into disk type (there are many devices of radial device type), surface mount type (chip type), and lamination layer (internal layer) device, and are properly used for respective applications. For example, the disk type is used for protection of 100V to 200V home appliances and peripheral circuits from high voltages and current pulses, such as a lightning surge. Moreover, the surface mount type and the lamination layer type are used for lower voltages and current pulses than those for the disk type. The higher the voltage and current type the larger the bulk size. This is because the smaller types cannot endure the lightning surge etc.

A chip varistor improved in surge current withstand for surge protection of electronic devices is disclosed in Patent Document 1, for example.

PRIOR ART DOCUMENTS

Patent Documents

Patent Document 1: JP 04-315402A

SUMMARY OF INVENTION

Problems to be Solved by the Invention

Progress in space saving of the electronic components and miniaturization thereof in recent years has demanded for a surface mount chip varistor, which can endure high voltages and current pulses. However, even conventional surface mounting varistors enlarged for high voltages and current pulses generate heat up to approximately 1000° C. when they short-circuit due to a pulse such as lightning surge. Therefore, the conventional structure disclosed in Patent Document 1, in which a varistor's base is in proximity to a substrate or a circuit board when the varistor is mounted on the substrate, has a problem that the risk of burning the substrate at the time when the varistor short-circuits is very high.

The present invention is devised in light of the problems described above, and it aims to provide a surface mount chip varistor for high voltages and current pulses, which has no risk of burning the substrate.

Means to Solve the Problems

It has the following structure as a means to attain the above-mentioned object and solve the problems mentioned above. That is, a surface mounting varistor is characterized in that a varistor element, electrodes deployed on respective sides of the varistor element, and paired frame terminals joined to the respective electrodes are covered by an insulating covering material; wherein the paired frame terminals respectively protrude from the insulating covering material and bent along a surface of the covering material, and front ends of the paired frame terminals sandwich a void formed on the bottom of the covering material, opposing each other.

In the structure, a leg with a predetermined height is formed on the bottom of the covering material. The covering material is characterized in that it is made up from, for example, a first resin layer for covering the varistor element, the electrodes, and the frame terminals, and a second resin layer for covering the first resin layer; wherein a leg with a predetermined height is formed on the bottom of the second resin layer.

For example, the void is characterized in that the void is a space which has a width equal to or greater than length of the electrodes, and with a height equal to or greater than ¾ the thickness of the varistor element. For example, the void is a space which has a width equal to or greater than the length of the varistor element, and with a height equal to or greater than ¾ the thickness of the varistor element.

For example, a through-hole is formed and deployed on each end of the paired frame terminals, and the frame terminals are welded to the electrodes via the through-hole.

Effect of Invention

According to the present invention, a surface mounting varistor, which can avoid risk of burning a substrate or a circuit board at the time when the varistor short-circuits, can be provided.

DESCRIPTION OF EMBODIMENTS

Figure 1:
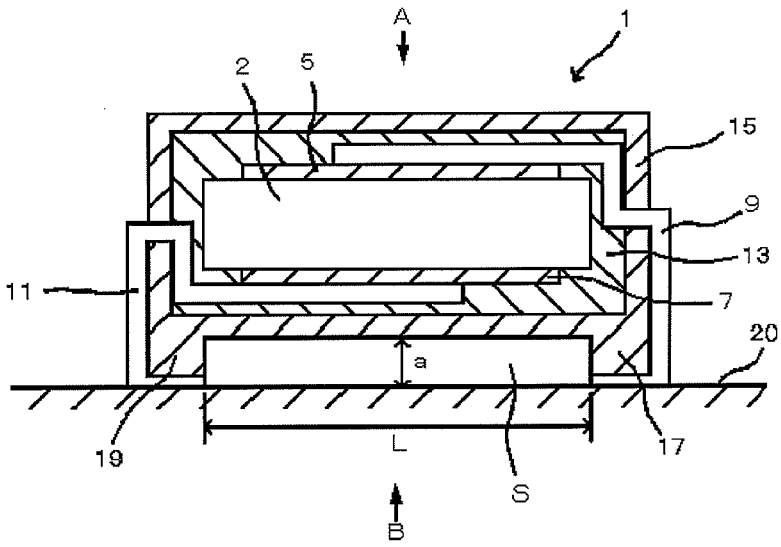
FIG. 1 illustrates a cross-sectional view of a structure of a surface mounting chip varistor according to an embodiment of the present invention.
Figure 2:
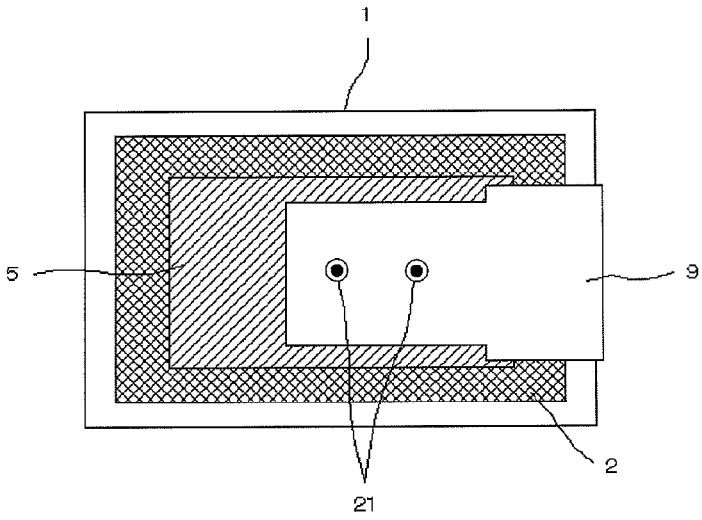
FIG. 2 illustrates an internal view of a connection between a terminal of the chip varistor and an upper electrode, according to the embodiment.
Figure 3:
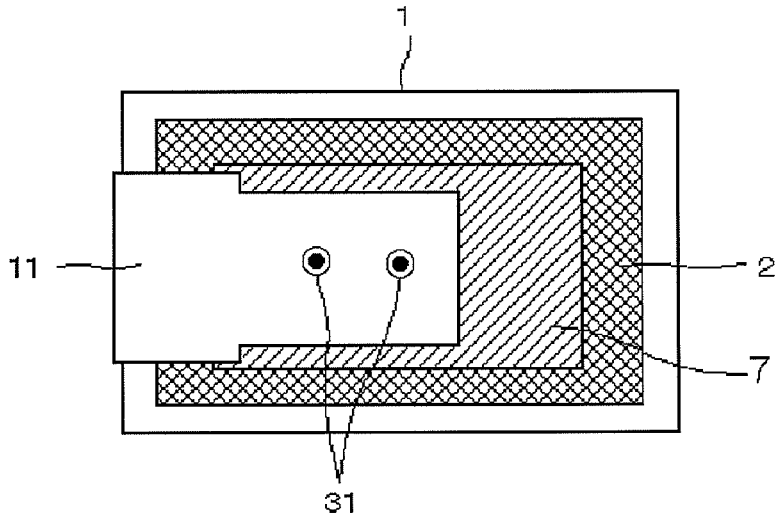
FIG. 3 illustrates an internal view of a connection between a terminal of the chip varistor and a lower electrode, according to the embodiment.
Figure 4:
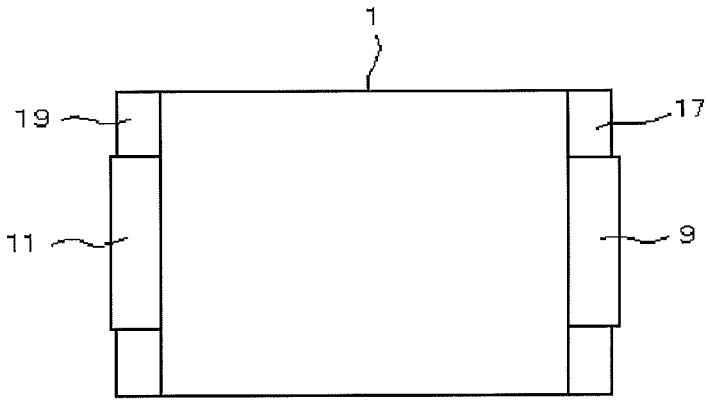
FIG. 4 illustrates a view of the chip varistor, according to the embodiment, when viewed from the bottom side.

Hereafter, an embodiment according to the present invention will be described in detail with reference to the drawings. FIG. 1 is a cross-sectional view showing a structure of a surface mounting chip varistor, according to the embodiment. FIG. 2 is an internal view showing a connection state of a terminal and an upper electrode of the chip varistor of FIG. 1 (when the chip varistor before molding is viewed along an arrow A of FIG. 1). FIG. 3 is an internal view showing a connection state of a terminal and a lower electrode of the chip varistor of FIG. 1 (when the chip varistor before molding is viewed along an arrow B of FIG. 1). FIG. 4 illustrates a view of the chip varistor of FIG. 1 when viewed from the bottom side thereof. Note that, 'surface mounting' device (varistor) according to the embodiment denotes a device 10 mm or less in mounting height, for example, and 240 to 820 V in varistor voltage.

As illustrated in FIG. 1, a chip varistor 1 according to the embodiment has a varistor element 2, which is made by mixing an additive to zinc oxide (ZnO), for example, and which has electrodes 5 and 7 formed on the front surface and the underside surface thereof. Furthermore, lead frame terminals 9 and 11 having a predetermined shape are electrically connected and attached to the surfaces of the electrodes 5 and 7. The varistor element 2 and the electrodes 5 and 7 are sealed together with the lead frame terminals 9 and 11 by resin molding, and are then covered by another resin molding.

More specifically, the chip varistor 1 according to the embodiment has a duplex (two layer) structure made from a first mold layer 13 for directly sealing the varistor element 2, etc., and a second mold layer 15 formed so as to cover the periphery of the first mold layer 13. The first mold layer 13 and the second mold layer 15 are a covering member for the chip varistor 1 according to the embodiment. Legs 17 and 19 are formed on the bottom of the second mold layer 15, and therefore when a chip varistor is mounted on a substrate (a mounting board) 20, a void (space) S described later is generated between the bottom of the covering member and the substrate due to the formed legs 17 and 19.

As described above, the covering member is made from two layers, and the legs 17 and 19 are formed at the time of forming the second mold layer 15 (secondary step), so that destruction of the legs at the time of reflow soldering can be further suppressed as compared to the case where only the first mold layer (primary mold) constitutes the legs in light of a relationship with release of stress. Moreover, regarding the first mold layer 13 and the second mold layer 15, the following structures are possible in light of a substrate combustion-avoiding effect: a structure with a first combination of the first mold layer made of epoxy resin and the second mold layer made of the same, for example, a structure with a second combination of the first mold layer 13 made of silicon resin and the second mold layer made of epoxy resin, and a structure with a third combination of a covering material having a hollow structure, that is, a covering case (covering member) made of epoxy resin, ceramics, etc. and a varistor element held inside the interior space thereof without directly touching the covering case. In addition, a structure with a single-layered covering member is possible also instead of the two-layer structure.

As illustrated in FIGS. 2 and 3, through-holes 21 and 31 are formed on connecting surfaces of the lead frame terminals 9 and 11 to be connected to the electrodes 5 and 7 by punching a lead frame through press-working, and the lead frame terminals are welded to the electrodes. The lead frame terminals 9 and 11 are made of phosphor bronze, the frame thickness thereof is, for example, 0.2 mm, and they are plated with Ni (nickel) and Sn (tin) into thickness of 2 to 6 μm.

In this embodiment, through-holes 21 and 31, 1 mm in diameter are formed in two places within a single frame. It is desirable to form multiple through-holes. Sn of the frame terminals and Sn contained in the electrodes 5 and 7 are melted, mixed together, and unified by welding heat, thereby giving strong adhesion. In addition, a wider melting area of the frame member etc. is secured by through-holes 21 and 31, thereby strengthening adhesion and providing an electrically excellent connection.

As illustrated in FIG. 1, the lead frame terminals 9 and 11 joined to respective electrodes 5 and 7 protrude from the covering material to the outside, and bent along the surface form of the covering material, into respective predetermined forms. The lead frame terminals 9 and 11 have such respective structures that respective front ends thereof end on respective bottoms of the legs 17 and 19 (surfaces on a mounting board side). As a result, the front ends of the lead frame terminals 9 and 11 sandwich the void S on the bottom of the covering material, are positioned facing each other and apart from each other at an equivalent distance to the width L of the void S.

Furthermore, the surface mounting chip varistor, according to the embodiment, has such a structure that the legs 17 and 19 with a predetermined height to be described later are formed on the bottom of the varistor 1 and on both ends of the bottom of the second mold layer 15 (covering material), and thus a space is generated between the bottom of the second mold layer 15 and the mounting board 20 when the varistor 1 is mounted on the board 20. As a result, the surface mounting varistor, according to the embodiment, has such a structure that the space (void) is provided between the varistor element 2 and the mounting board 20. Therefore, there is little risk of burning the substrate or the board even if the varistor short-circuits due to a high voltage and current pulse and has a high temperature.

Distance a between the bottom of the varistor 1 (bottom of the second mold layer 15) and the mounting board 20 (spatial distance of the void S) is decided by heights of the legs 17 and 19. This spatial distance a is preferably not less than 1.8 mm, and is desirably not less than ¾ the thickness of the varistor element 2. Moreover, dimension L (length) of the void S is equal to or greater than the electrodes 5 and 7 arranged on the varistor element 2. Note that dimension L of the void S may be equal to or greater than dimension L of the varistor element 2. In this case, a surface mounting varistor that does not burn the front surface of the mounting board even if the varistor short-circuits and thus has a high temperature may be provided.

Figure 5:
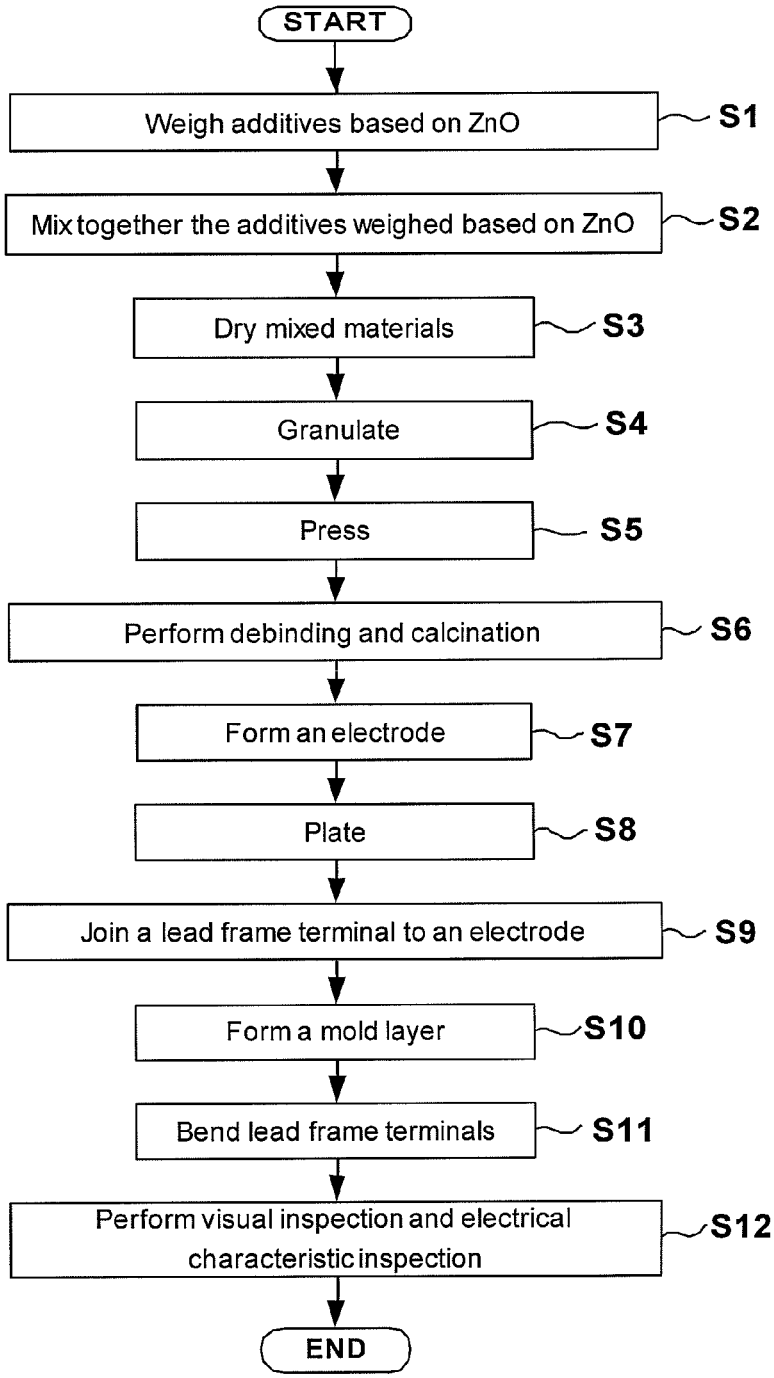
FIG. 5 is a flow chart for explaining in time series a manufacturing process of a chip varistor, according to the embodiment.

A chip varistor manufacturing process according to an embodiment will be explained next. FIG. 5 is a flowchart for explaining in time series a chip varistor manufacturing process, according to the embodiment. In Step S1 of FIG. 5, a varistor raw material of the varistor element 2 is prepared. For example, 100 mol % zinc oxide (ZnO) approximately 3 μm in median particle diameter is used to weigh 0.2 mol % bismuth oxide ($Bi_2O_3$), 4.0 mol % cobalt oxide (CoO), 4.0 mol % manganese dioxide ($MnO_2$), 3.5 mol % antimony oxide ($Sb_2O_3$), 1.0 mol % chrome oxide ($Cr_2O_3$), 1.0 mol % boric acid ($H_3BO_3$), and approximately 0.1 mol % aluminum oxide ($Al_2O_3$) as materials for the varistor element, with an electronic balance etc.

In Step S2, the varistor element materials weighed in Step S1 are mixed together by a ball grinder (a ball milling machine). Herein, such mixture is made by rotating at a speed of 45 revolutions per minute for 24 hours using, for example, a medium (YTZ15ϕ) and ion exchange water as a mixed solvent. In Step S3, the resulting mixed material is dried at 120° C. for 24 hours using a drying oven. In subsequent Step S4, a PVA solution, for example, is added to the mixed material dried in Step S3, and the resulting material is granulated using a triturator etc.

In Step S5, a press load of 1200 Kgf is applied using, for example, a rotary pressing machine, so as to form a molded body approximately 2 mm in thickness. In Step S6, the molded body is held in a sintering furnace for 1.5 hours at 1140° C., and debinding and calcination are performed at a heating/cooling temperature rate of 200° C./hr.

Figure 6:
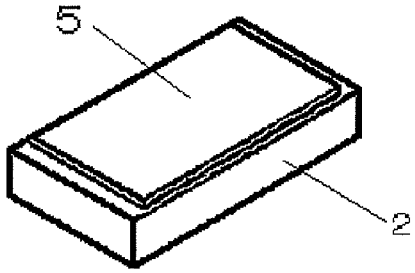
FIG. 6 illustrates the state where an electrode is formed on a varistor element, according to the embodiment.

In Step S7, an electrode is formed using an electrode firing furnace. An electrode is formed on, for example, the molded body formed in the above-mentioned step, more specifically, on either side of the varistor element using Ag glass paste etc., and is then baked at 540° C. for 10 minutes. The heating rate at this time is set to 800° C./hr, and it is annealed after baking. FIG. 6 shows the state where the electrode is formed on the surface of the varistor element in the processing of Step S7. FIG. 6 illustrates the state where an electrode is formed in the varistor element according to the embodiment. In FIG. 6, reference numeral 2 denotes a varistor element, and 5 denotes an electrode. Note that an additional electrode 7 is also formed on the underside surface of where the electrode 5 of the varistor element 2 is formed.

In subsequent Step S8, plated layers: a Ni layer and a Sn layer are formed in this order by electrolytic plating so as to cover the electrode 5. Nickel plating thickness is set to 2 to 6 μm, and Sn plating thickness is set to 3 to 8 μm, for example. Through-holes are formed in two places of the lead frame terminal by press working. In Step S9, a lead frame terminal is joined to the electrode through welding etc. using a welder.

Figure 7:
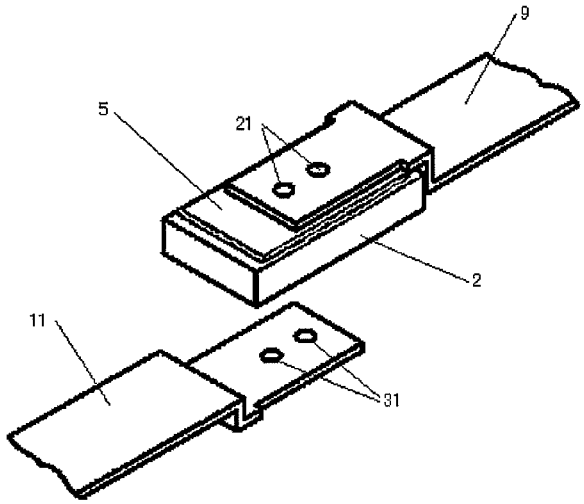
FIG. 7 is a view for explaining a process of joining a lead frame to an electrode according to the embodiment.

The state of joining a lead frame is shown in FIG. 7. FIG. 7 is a view for explaining the step of joining the lead frame to the electrode, according to the embodiment. FIG. 7 shows the state before the lead frame 9 is connected and fixed to the electrode 5 and the lead frame 11 is connected to the electrode 7. As illustrated in FIG. 7, the through-holes 21 and 31 are formed beforehand in the lead frames 9 and 11, which are bent in accordance with thickness of the varistor element to be joined and thickness of the electrode and are molded so that width of a connecting portion with the electrode is slightly narrower, according to the embodiment.

In Step S10, the chip varistor is molded. The chip varistor according to the embodiment is formed through duplex molding, as mentioned above. Therefore, in the first step, the first mold layer 13 for directly sealing the varistor element 2 with LCP resin and Si resin through injection molding is formed here.

Figure 8:
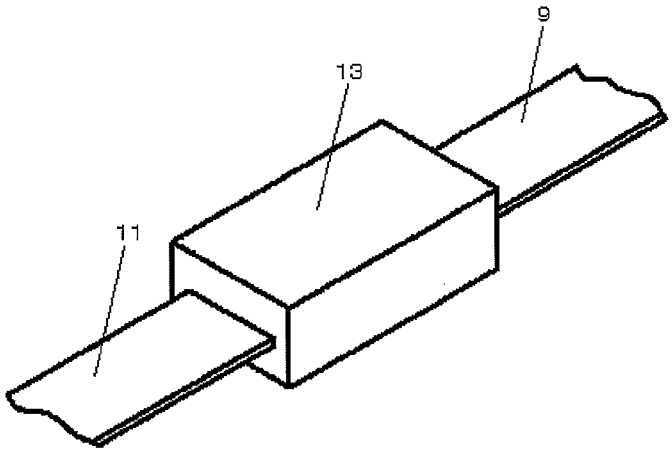
FIG. 8 illustrates the state where a first mold layer (primary mold layer) is formed according to the embodiment.

FIG. 8 shows the state where the first molding is formed. FIG. 8 shows the state where the first mold layer (primary mold layer) is formed according to the embodiment. As shown in FIG. 8, in the state where the first mold layer 13 is formed, the lead frames 9 and 11 extend outside the first mold layer 13.

Figure 9:
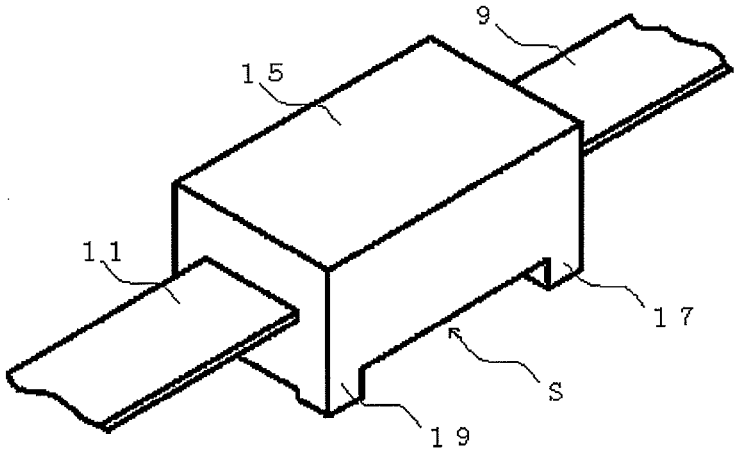
FIG. 9 illustrates the state where a second mold layer (secondary mold layer) is formed according to an embodiment.

Subsequently, in the same manner, the second mold layer 15 is formed, so as to cover the periphery of the first mold layer 13 through injection molding. The state where the second mold layer 15 is formed is shown in FIG. 9. FIG. 9 illustrates the state where the second mold layer (secondary mold layer) is formed, according to the embodiment. As illustrated in FIG. 9, the legs 17 and 19 extending towards the mounting board are formed on the bottom of the second mold layer 15, and the space S is formed between the legs 17 and 19.

Figure 10:
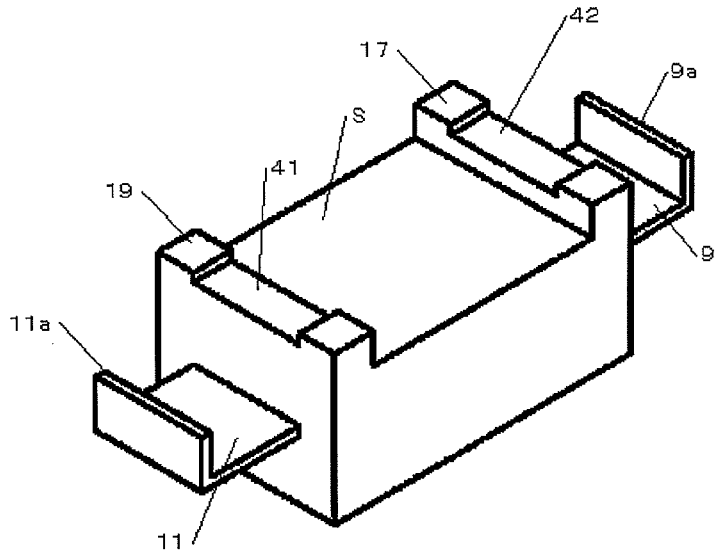
FIG. 10 is a view for explaining the state where a lead frame front end is bent according to the embodiment.

In Step S11, the lead frame terminals 9 and 11 protruding from the above-mentioned covering material are processed using a forming machine so as to be bent along the surface of the covering material, into a predetermined form. The state where the front end of the lead frame is bent is shown in FIG. 10. FIG. 10 is for explaining the state where the lead frame front end according to the embodiment is bent.

In FIG. 10, front ends 9*a* and 11*a* of the lead frames 9 and 11 are bent (primary forming), thereby allowing them to be stored and fitted in concave portions 41 and 42 of the legs 17 and 19, and then cut so that length of the bent front ends becomes equal to width of the legs 17 and 19 if needed. The concave portions 41 and 42 for accommodating the lead frames 9 and 11 are formed on mounting surfaces of the legs 17 and 19 (contact surfaces with the mounting board). Depth of the concave portions 41 and 42 is almost the same as thickness of the lead frames 9 and 11.

Following the state in FIG. 10, secondary forming of bending the lead frames 9 and 11 extending outside the second mold layer 15 (covering material) is performed, so as for the front ends to be accommodated in the concave portion 41 and 42 of the legs 17 and 19, entering the state where the front ends 9*a* and 11*a* of the lead frames are stored in the concave portions 41 and 42. Since the front ends 9*a* and 11*a* are settled in the concave portion 41 and 42, flatness of the mounting surface is improved, allowing secure mounting.

Figure 11:
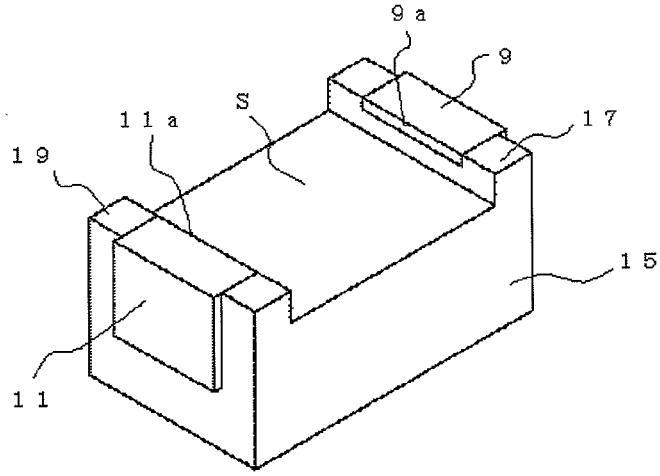
FIG. 11 is a view of a folded lead frame according to the embodiment when viewed from the bottom side.
Figure 12:
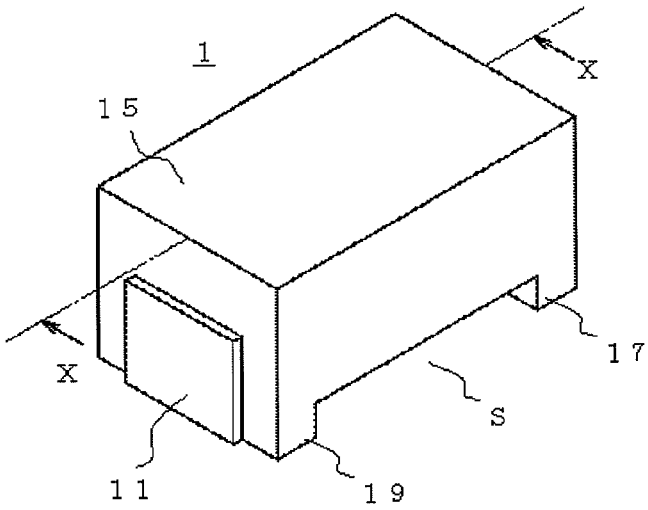
FIG. 12 is a view of the folded lead frame according to the embodiment when viewed from the top side.

The state where the secondary forming of the lead frames 9 and 11 is completed is shown in FIGS. 11 and 12. FIG. 11 is a view of the bent lead frame according to the embodiment when viewed from the bottom side. FIG. 12 is a view of the bent lead frame according to the embodiment when viewed from the upper side. In FIG. 11, reference numerals 9*a* and 11*a* denote lead frame front ends (terminal front ends). As illustrated, the bases of the legs 17 and 19 are kept almost flat, and flatness of the mounting surface is maintained.

Figure 13:
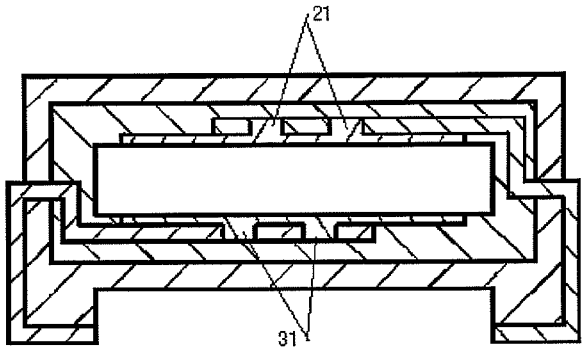
FIG. 13 is a cross-sectional view cut along a line X-X of FIG. 12.

FIG. 13 is a cross-sectional view cut along a line X-X of FIG. 12. Since FIG. 13 is the same as FIG. 1 except that through-holes are illustrated, the other reference numerals are omitted. In FIG. 13, reference numerals 21 and 31 denote through-holes, which according to the embodiment, are filled up with a conductive material through welding in Step S9, and the lead frame 9 and the varistor element 2 are fixed securely.

Note that, as apparent from FIG. 13, the lead frames 9 and 11 are bent beforehand, so as for positions of lead frames of the upper and the lower surface protruding from the covering material to be almost the same on either side of the covering material. Moreover, they are bent so that distances between both ends of the varistor element 2 and the respective bent lead frames become almost the same.

Since the surface mounting varistor according to the embodiment is manufactured in the aforementioned steps, visual inspection of all of the manufactured surface mounting varistors and electrical characteristic inspection of varistor voltage and leakage current and the like are carried out in the following Step S12.

Figure 14:
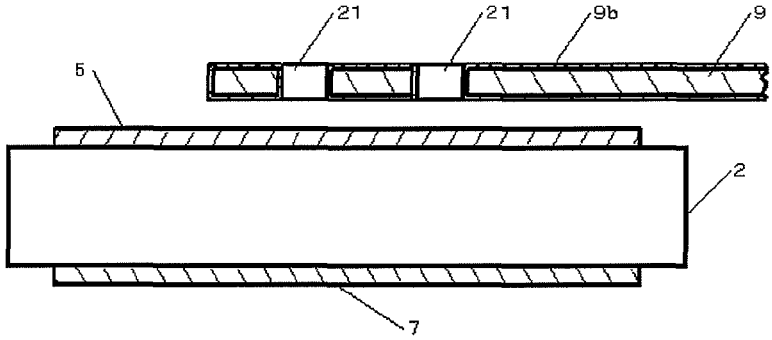
FIG. 14 is a cross-sectional view for explaining a lead frame and an electrode, according to the embodiment, in detail.
Figure 15:
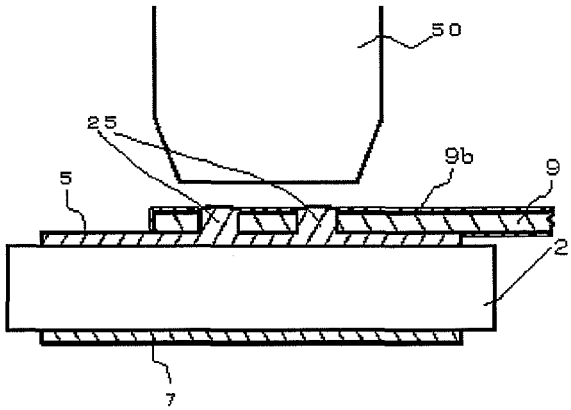
FIG. 15 is a cross-sectional view for explaining a joining process for the lead frame and the electrode, according to the embodiment.

Details of a junction treatment of the lead frames and the electrodes in the above-mentioned Step S9 are explained below with reference to FIGS. 14 and 15. FIG. 14 is a cross-sectional view for explaining in detail the lead frames and electrodes, according to the embodiment. FIG. 15 is a cross-sectional view for explaining a junction treatment of the lead frames and electrodes, according to the embodiment.

In the embodiment, the plated layer 9*a* is formed beforehand on the surfaces of the lead frames 9 and 11. The plated layer may be made of nickel (Ni) or tin (Sn), for example, through arbitrary conductive metal plating. As illustrated in FIG. 14, the plated lead frame 9 is positioned at a predetermined upper location from the electrode 5 so that the portion in which the through-hole 21 is formed should come in contact with the electrode 5.

Afterwards, as illustrated in FIG. 15, the lead frame 9 is brought into contact with the electrode 5, and then heat-crimped using a heater 50. At this time, the plated layer 9*b* on the surface of the lead frame 9 and plated layer on the surface of the electrode 5 melt and fill in the through-hole 21. Reference numeral 25 denotes a conductive material filling in the through-hole resulting from melting the plated layers. Therefore, the lead frame 9 and the varistor element 2 are fixed together securely. Similarly, the through-hole 31 of the lead frame 11 is brought into contact with the electrode 7, and the lead frame 11 and the electrode 7 are heat-crimped.

Results from sample evaluation of chip varistors according to the embodiment are explained below. The chip varistors used for evaluation are made from a 14 mm varistor element with a varistor voltage of 470 V; wherein Ag electrodes containing 65 wt % silver metal and 35 wt % borosilicate glass and others are used. The electrodes are joined to the lead frame terminals through lead-free soldering. Herein, distance (spatial distance) a from the mounting board surface to the bottom of a product (chip varistor) is changed, and quality of 20 samples is evaluated for a variety of distances. Table 1 shows the evaluation results of the samples.

TABLE 1

| Evaluation items | Distance a from mounting board surface to product (mm) | | | | | | | | | | | | | | |
|---|---|---|---|---|---|---|---|---|---|---|---|---|---|---|---|
| | 0.2 | 0.4 | 0.6 | 0.8 | 1.0 | 1.2 | 1.4 | 1.6 | 1.8 | 2.0 | 2.2 | 2.4 | 2.6 | 2.8 | 3.0 |
| Number of combustions occurred Terminal thickness: 2.4 mm | 20 | 20 | 20 | 16 | 15 | 12 | 6 | 1 | 0 | 0 | 0 | 0 | 0 | 0 | 0 |
| Number of combustions occurred Terminal thickness: 1.8 mm | (No detailed data) | | | | | | | | 0 | 0 | 0 | 0 | 0 | 0 | 0 |

Criteria for sample quality evaluation are: no combustion, emitting smoke, and ignition occur on a mounting board surface on which the varistor product is mounted after applying a test voltage to the varistor product; and there is enumerated data for combustion, emitting smoke, and ignition, which are respectively enumerated using the board surface as a reference plane, for distance a from the reference plane to respective varistor products (varistor bases). As a result, it is found that height (spatial distance) a from the mounting board to the varistor base is preferably no less than 1.8 mm, and is desirably no less than ¾ the thickness of the varistor element.

According to the embodiment, a void is formed on the bottom of the covering material for the surface mounting chip varistor, as explained above. Such a structure lessens the risk of burning the mounting board (substrate) even if the varistor short-circuits due to a high voltage and current pulse because a space (void) can be provided between the varistor element and the mounting board when the varistor is mounted on the board. Moreover, a surface mounting chip varistor having a varistor characteristic that is excellent as a circuit protection element may be provided.

DESCRIPTION OF REFERENCE NUMERALS

1 Chip varistor
2 Varistor element
5, 7 Electrode
9, 11 Lead frame terminal
13 First mold layer
15 Second mold layer
17, 19 Leg
20 Mounting board (substrate)
21, 31 Through-hole
a Spatial distance
L Dimension of void
S Void (space)

The invention claimed is:

1. A surface mounting varistor, in which a varistor element, electrodes deployed on respective sides of the varistor element, and paired frame terminals joined to the respective electrodes are covered by an insulating covering material; wherein legs with a predetermined height are formed on the bottom of the covering material, the paired frame terminals respectively protrude from the insulating covering material and bent along a surface of the legs, and front ends of the paired frame terminals sandwich a void formed between the legs on the bottom of the covering material, opposing each other.

2. The surface mounting varistor according to claim 1, wherein the covering material comprises: a first resin layer for covering the varistor element, the electrodes, and the frame terminals, and a second resin layer for covering the first resin layer; wherein legs with a predetermined height are formed on the bottom of the second resin layer.

3. The surface mounting varistor according to claim 2, wherein the void is a space which has a width equal to or greater than length of the electrodes, and with a height equal to or greater than ¾ the thickness of the varistor element.

4. The surface mounting varistor according to claim 2, wherein the void is a space which has a width equal to or greater than the length of the varistor element, and with a height equal to or greater than ¾ the thickness of the varistor element.

5. The surface mounting varistor according to claim 1, wherein a through-hole is formed in the paired frame terminals, and a portion in which the through-hole in the frame terminals is formed is welded to the electrodes.

6. The surface mounting varistor according to claim 5, wherein a through-hole is formed in a junction with the electrodes of the frame terminals, a plated layer is formed beforehand in the frame terminals, and at the time of welding the frame terminals and the electrodes, the junction is heated, melting and filling the plated layer into the through-hole.

7. The surface mounting varistor according to claim 5, wherein the frame terminals are bent before being welded to the electrodes, so as to be positioned at almost the same protruding positions on both side surface of the covering material.

* * * * *